US005997210A

United States Patent [19]

Shirakawa

[11] Patent Number: 5,997,210

[45] Date of Patent: Dec. 7, 1999

[54] FIXTURE AND METHOD FOR FIXING A PLURALITY OF PLATES

[75] Inventor: Mitsuya Shirakawa, Osaka, Japan

[73] Assignee: Miyagawa Kasei Industry Co., Ltd., Osaka, Japan

[21] Appl. No.: 09/028,541

[22] Filed: Feb. 24, 1998

[30] Foreign Application Priority Data

Aug. 19, 1997 [JP] Japan ..... 9-222363

[51] Int. Cl.[6] ..... E01C 11/22

[52] U.S. Cl. ..... 404/2; 404/25

[58] Field of Search ..... 404/40, 2; 52/11

[56] References Cited

U.S. PATENT DOCUMENTS

Re. 33,439 11/1990 Thomann et al. ..... 404/2

580,701 4/1897 McMenamin ..... 404/2

4,630,962 12/1986 Thomann et al. ..... 404/2

5,339,575 8/1994 Kuhns ..... 52/12

5,437,516 8/1995 Sauerwein et al. ..... 404/2

5,564,860 10/1996 Amann ..... 405/118

*Primary Examiner*—Thomas B. Will

*Assistant Examiner*—Raymond W Addie

*Attorney, Agent, or Firm*—W. G. Fasse

[57] ABSTRACT

A decking plate is arranged on a cover plate over the open top of a U shaped channel, such that a through hole of the decking plate is positioned aligned over a cutout portion of the cover plate. A fixture is inserted through the through hole and the cutout portion. The fixture includes a head, a screw, a tube like portion and a protrusion. The cover plate and the decking plate are pinched and fixed together between the head and the protrusion of the feature. Thus, a positioned displacement of a attached plurality of plates can be prevented.

15 Claims, 3 Drawing Sheets

FIXTURE AND METHOD FOR FIXING A PLURALITY OF PLATES

BACKGROUND OF THE INVENTION

1. Field of the Invention

The present invention relates to fixtures and methods for fixing a plurality of plates, and more specifically, to a fixture and a method for fixing a plurality of plates each having a through hole in a stack.

2. Description of the Background Art

Conventionally, a U shaped groove, trough or channel 3 shown in FIG. 6 has been widely known for example as a drainage channel. A cover or a lid 2 is generally placed on the to of the U shaped groove or channel 3. When such a U shaped groove or channel 3 is arranged for example on a construction site, and vehicles are intended to pass thereover, a decking 1 is preferably placed on cover 2 for protection, as shown in FIG. 6. The provision of decking 1 ensures safety as a vehicle passes over U shaped groove 3.

However, as shown in FIG. 6, the above mentioned, decking 1 is often displaced from its proper position on cover 2 because it is simply placed loosely onto cover 2. Thus, decking 1 cannot fully exhibit its function of protecting cover 2. In addition, when decking 1 is made for example of resin and light in weight, it may possibly be lifted or taken away.

SUMMARY OF THE INVENTION

The present invention is made to solve the aforementioned problem. An object of the present invention is to provide a fixture and a method for fixing a plurality of plates, so as to achieve full protection for a plate such as a cover for an by U shaped groove or channel and so as to reduce the possibility of lifting of the plates.

The fixture for a plurality of plates according to the present invention fixes, onto a first plate having a first through hole, a second plate having a second through hole stacked on said first plate. The fixture includes a head, a screw, a tube like portion and a protrusion. The screw downwardly extends from the head and has a male screw threading on its outer surface. The tube like portion is provided with a female screw threading on its inner surface and the screw is received therein. The protrusion outwardly protrudes from the outer surface of the tube like portion. The fixture having the above mentioned structure pinches and fixes the first and second plates between the head and the protrusion, with the screw inserted into the first and second through holes. It is noted that the above mentioned first and second through holes encompass cutout portions which are provided at the ends of the first and second plates and pass therethrough in a direction of thickness.

As described above, the fixture for a plurality of plates according to the present invention includes the head and the protrusion, and fixes and pinches the first and second plates therebetween. Thus, positioned displacement of the second plate on the first plate is prevented, so that the second plate can provide full protection for the first plate. In addition, if the first and second plates are fixed together using the above mentioned fixture, the first and second plates connected to each other are not easily carried away even if the plates are not secured to the U shaped channel, for example when the first plate is made of concrete and heavy in weight. Further, by connecting fixtures together, a number of first and second plates are connected, so that they are not easily carried away. This may serve as a theft deterrent.

The above mentioned first and second through holes preferably have a first opening width and a second opening width which is smaller than the first opening width. Then, a sum of a protrusion length of the protrusion and a width of the tube like portion (a length corresponding to L1 in FIG. 3) is set smaller than the first opening width and larger than the second opening width. Here, the width of the tube like portion is determined adjacent to the protrusion, and corresponds to the width at the portion between protrusions 4*d* in FIG. 3.

As mentioned above, by setting the sum of the protrusion length of the protrusion and the width of the tube like portion to be smaller than the first opening width, the screw with a tube like portion received thereon can be inserted into the first and second through holes from above so that the protrusion is positioned under the first plate. Thus, as the screw with the tube like portion received thereon needs only to be inserted into the first and second through holes from above, the insertion is accomplished quite easily. Thereafter, by rotating the protrusion, the protrusion can be positioned immediately below a portion of the first plate defining the second opening width of the first through hole. Then, the screw is rotated about its axis and moved in a direction in which the head comes closer to the protrusion with the protrusion abutting against the bottom surface of the first plate, so that the first and second plates are pinched between the bottom surface of the head and the upper surface of the protrusion. Thus, the first and second plates are fixed together simply by rotating the protrusion and the screw after inserting the screw with the tube like portion received thereon into the first and second through holes. Accordingly, the fixing operation for the first and second plates is extremely facilitated.

In a method of fixing a plurality of plates according to the present invention, a second plate having a second through hole is stacked and fixed on a first plate having a first through hole for which the following fixture is used. The fixture includes a head, a screw downwardly extending from the head and having a male screw threading formed on its outer surface, a tube like portion having a female screw threading on its inner surface and receiving the screw, and a protrusion outwardly protruding from the outer surface of the tube like portion. The method of fixing a plurality of plates according to the present invention includes the following steps. The second plate is placed on the first plate such that the second through hole is positioned on the first through hole. By inserting the screw with the tube like portion received thereon into the first and second through holes from above, the protrusion is arranged below the first plate. The first and second plates are pinched and fixed between the protrusion and the head by rotating the protrusion and the screw. It is noted that the above mentioned first and second through holes have a first opening width allowing passage of the protrusion therethrough, and a second opening width which is smaller than the first opening width, i.e. each of the through holes has an elongated or slotted hole shape that is longer than it is wide.

As in the foregoing, in the method of fixing a plurality of plates according to the present invention, by inserting the screw with the tube like portion received thereon into the first and second through holes from the position above the second plate, the protrusion is arranged below the first plate. As the screw with the tube like portion received thereon needs only to be inserted into the first and second through holes from the position above the second plate, the screw can be extremely readily inserted. It is noted that the inserting operation is made possible by the fact that the first and second through holes have the first opening width which allows passage of the protrusion therethrough. Subsequent to the insertion, the protrusion and the screw are rotated. The rotation of the protrusion is readily achieved, for example simply by manually rotating the screw about its axis. The rotation of the protrusion enables engagement between the protrusion and the first plate. This is because the first through hole has the second opening width which is smaller than the first opening width. The rotation of the screw by itself is accomplished for example simply by rotating the screw along with the head, while preventing rotation of the protrusion by abutting the upper surface of the protrusion against the back surface of the first plate. Thus, the screw is readily rotated by itself. By rotating the screw along with the head while preventing rotation of the protrusion, the head can be moved in a direction which comes closer to the tube like portion. Thus, the first and second plates can be pinched and fixed between the head and the protrusion.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
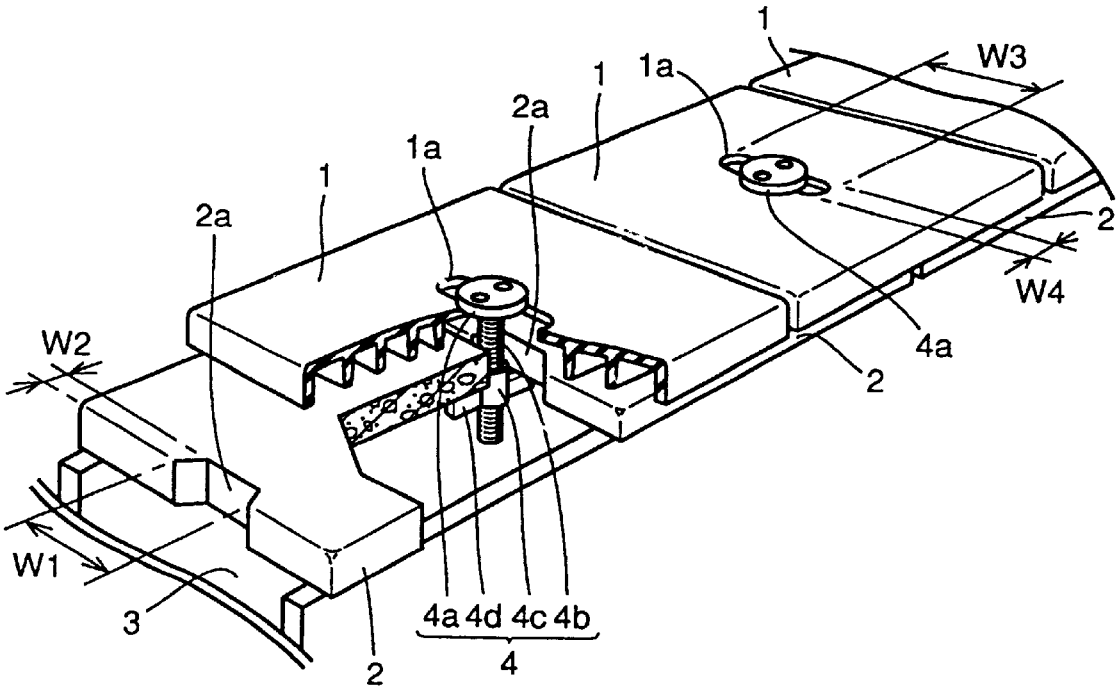
FIG. 1 is a partially sectional perspective view showing a structure of a plurality of plates fixed according to an embodiment of the present invention.
Figure 2:
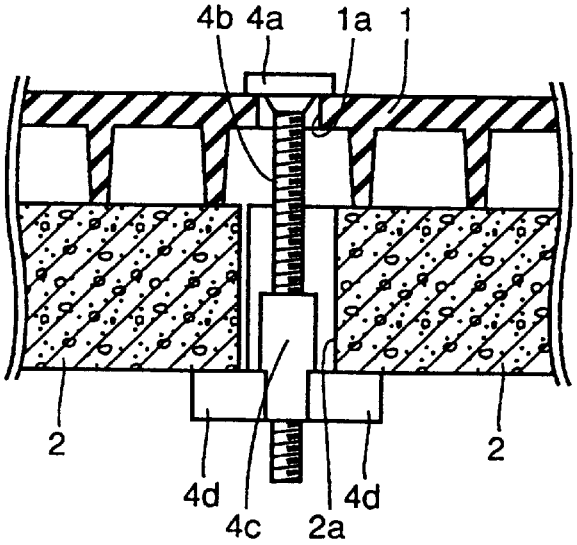
FIG. 2 is a cross sectional view showing an enlarged detailed structure shown in FIG. 1.

An embodiment of the present invention will now be described with reference to FIGS. 1 to 5. FIG. 1 is a partially sectional perspective view showing a cover 2 and a decking 1 for a U shaped groove or channel 3, which have been fixed using a fixture 4 according to the present invention. FIG. 2 is a cross sectional view showing an enlarged detail of the structure shown in FIG. 1. Note that the decking 1 is fixed to cover 2 by the fixture 4, but the cover 2 is not secured to the U shaped channel 3 but rather simply placed loosely thereon.

Referring first to FIG. 1, cover 2 made of concrete has, at its one end, a cutout portion 2*a* passing through cover 2 in a direction of thickness. Cutout portion 2*a* has a first opening width W1 and a second opening width W2 which is smaller than first opening width W1. Placed on cover 2 is a decking 1, which is made of resin. Decking 1 has a through hole 1*a* in its middle portion. Through hole 1*a* has a first opening width W3 and a second opening width W4 which is smaller than the first opening width W3.

As shown in FIG. 1, decking 1 is placed on cover 2 such that through hole 1*a* is positioned on cutout portion 2*a*. Fixture 4 is mounted to extend from through hole 1*a* to cutout portion 2*a*. Fixture 4 includes a head 4*a* having a generally disk-like shape, a screw 4*b* extending downwardly from head 4*a* and having a male screw threading on its outer surface, a tube like portion 4*c* having a female screw threading on its inner surface and receiving screw 4*b*, and a protrusion 4*d* outwardly protruding from the outer surface of tube like portion 4*c*.

As shown in FIG. 2, by pinching cover 2 and decking 1 between head 4*a* and protrusion 4*d*, cover 2 and decking 1 are fixed to each other. Thus, decking 1 cannot be displaced from cover 2, thereby ensuring that decking 1 provides protection for cover 2. As a result, safety when a vehicle or the like passes over cover 2 is improved. It is noted that a concave portion (not shown) for receiving protrusion 4*d* may be provided on the back surface of cover 2. This prevents rotation of protrusion 4*d* while mounting fixture 4 or after cover 2 and decking 1 are fixed together. Therefore, efficient mounting operation for fixture 4 as well as improvement in reliability after cover 2 and decking 1 are fixed together are achieved.

Figure 3:
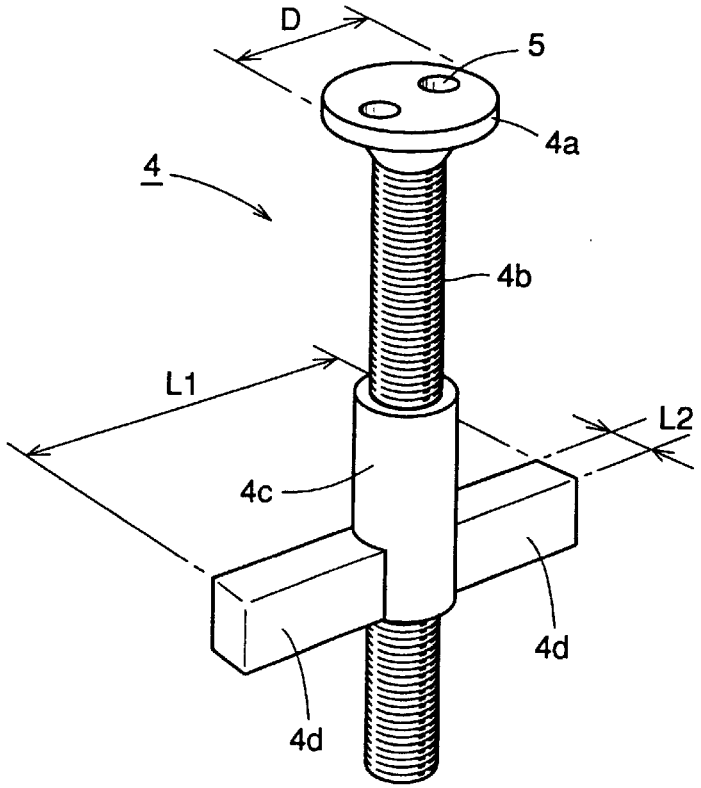
FIG. 3 is a perspective view exemplifying a fixture according to the present invention.

Referring now to FIG. 3, the structure of fixture 4 will be described in detail. A pair of holes 5 are formed in head 4*a*. Holes 5 are formed for rotating screw 4*b* along with head 4*a*. Holes 5 may or may not pass through head 4*a*. The provision of holes 5 allows rotation of screw 4*b* along with head 4*a* using a jig having for example a pair of convex portions which can be fit into holes 5. Thus, rotation of screw 4*b* is accomplished both readily and efficiently. It is noted that a concave or convex element other than the above mentioned holes 5 may be provided for head 4*a*, as long as it is useful for rotation of head 4*a*.

Diameter D of head 4*a* is set larger than second opening widths W2 and W4. Thus, the bottom surface of head 4*a* and the upper surface of decking 1 are made engageable. It is noted that, while a planar shape of head 4*a* shown for example in FIG. 3 is round, it may have any other shape, such as a triangle or a square.

The above mentioned head 4*a* and screw 4*b* are integrated together, with screw 4*b* having a straight shape. Tube like portion 4*c* receiving screw 4*b* extending therethrough has a cylindrical shape. Tube like portion 4*c* can, however, have a shape other than the cylindrical shape. For example, it may be a square pole. A pair of protrusions 4*d* are formed outwardly protruding from the outer surface of tube like portion 4*c*. The pair of protrusions 4*d* extend in opposite directions in the example shown in FIG. 3.

A sum L1 of the protrusion length of the above mentioned pair of protrusions 4*d* and the width of tube like portion 4*c* in a portion which is adjacent to protrusion 4*d* is set smaller than first opening width W1 or W3 and larger than second opening width W2 or W4. In addition, a maximum value of the width for tube like portion 4*c* and a width L2 of protrusion 4*d* are set smaller than second opening widths W2 and W4. As the above mentioned sum L1 and width L2 are respectively smaller than first opening width W1 or W3 and second opening width W2 or W4, screw 4*b* with tube like portion 4*c* screwed thereon can be inserted into and through first through hole 1*a* and cutout portion 2*a*. Further, as the above mentioned sum L1 is larger than second opening width W2, protrusion 4*d* can be rotated and engaged with cover 2. Thus, cover 2 and decking 1 are pinched between head 4*a* and protrusion 4*d*.

At this time, as shown in FIG. 3, if protrusion 4*d* extends in a direction which is orthogonal to the axial direction of tube like portion 4*c* and has a planar upper surface, contact area between protrusion 4*d* and the back surface of cover 2 can be increased. Thus, rotation of protrusion 4*d* while mounting fixture 4 is effectively prevented, so that cover 2 is tightly fixed against decking 1 by fixture 4. It is noted that the upper surface of protrusion 4*d* can be provided with fine irregularities for preventing its rotation with respect to the back surface of cover 2. When the back surface of cover 2 is structured as a horizontal plane as shown for example in FIG. 2, protrusion 4*d* can extend in the direction which is orthogonal to the axial direction of tube like portion 4*c* as mentioned above. On the other hand, when the back surface of cover 2 is structured as an inclined plane or the like, it is preferable to extend protrusion 4*d* along the back surface of cover 2 or to form the upper surface of protrusion 4*d* in a shape which fits the shape of the back surface of cover 2. Thus, the contact area between the upper surface of protrusion 4*d* and the back surface of cover 2 can surely be increased.

Figure 4:
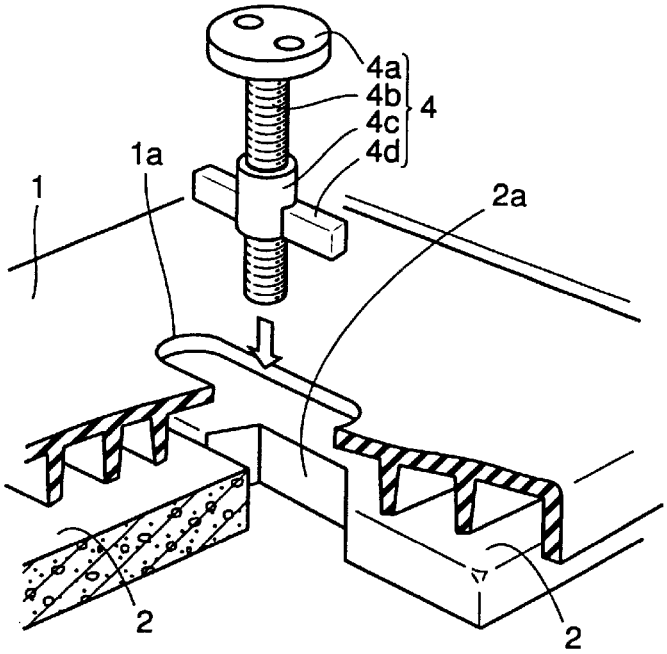
FIGS. 4 and 5 are partially sectional perspective views showing characteristic first and second steps of a method of fixing a plurality of plates according to the embodiment of the present invention.
Figure 5:
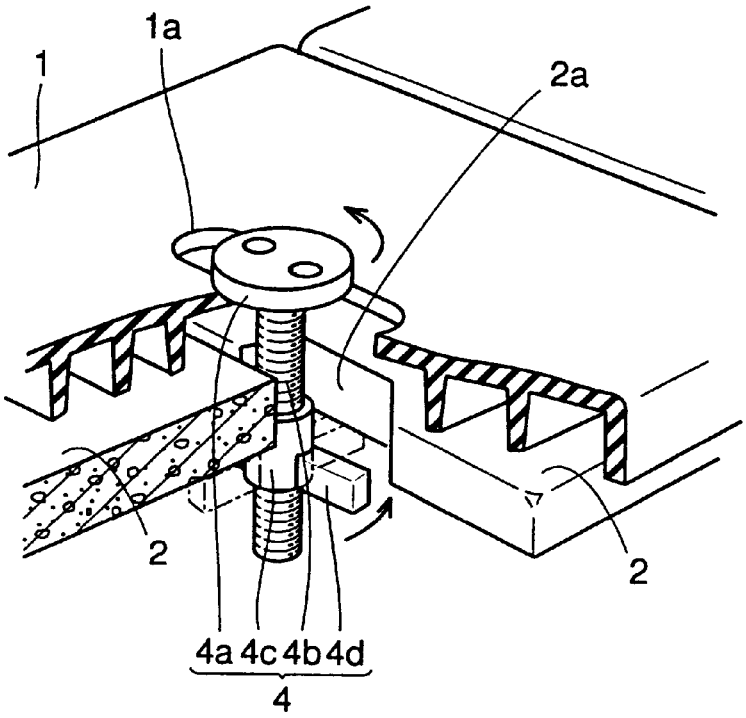
Figure 6:
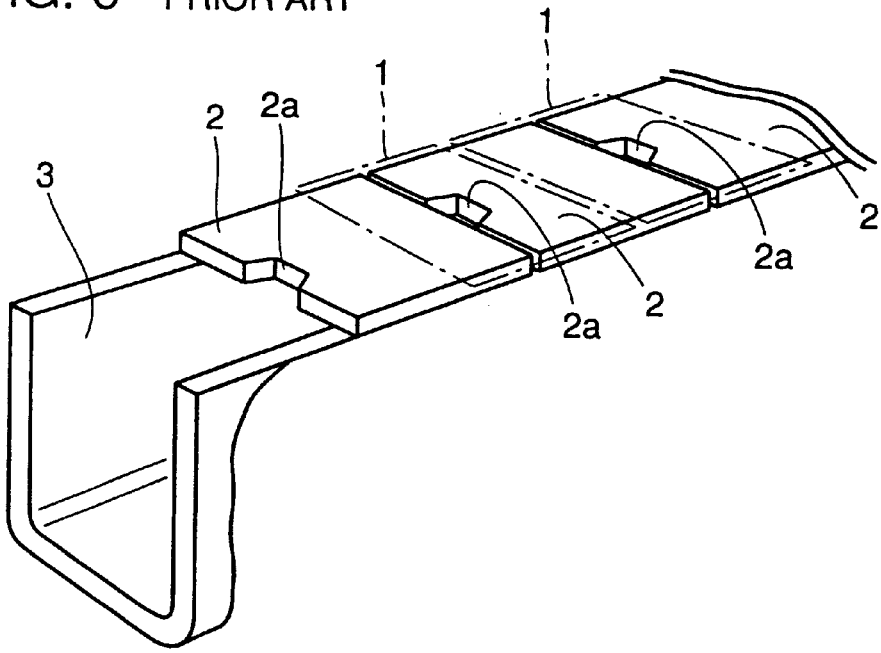
FIG. 6 PRIOR ART
FIG. 6 is a perspective view showing a conventional structure in which a decking is loosely placed on a cover arranged on the upper end of an U shaped groove or channel.

With reference now to FIGS. 4 and 5, a method of fixing a plurality of plates using a fixture 4 according to the present invention will be described. FIGS. 4 and 5 are partially sectional perspective views showing characteristic first and second steps of the method of fixing a plurality of plates according to the present invention.

Referring to FIG. 4, a decking 1 is placed on a cover 2 such that a through hole 1*a* is positioned on a cutout portion 2*a*. Then, fixture 4 is inserted into through hole 1*a* and cutout portion 2*a* from above decking 1. More specifically, a screw 4*b* with a tube like portion 4*c* screwed thereon is inserted into and through the through hole 1*a* and cutout portion 2*a* from the side of protrusion 4*d*. The inserting operation can be extremely readily accomplished as fixture 4 needs only be inserted into through hole 1*a* and cutout portion 2*a* from above decking 1.

Referring now to FIG. 5, by inserting screw 4*b* into through hole 1*a* and cutout portion 2*a*, protrusion 4*d* is arranged below the bottom surface of cover 2. Thereafter, protrusion 4*d* is rotated in a direction indicated by an arrow shown in FIG. 5. Rotation of protrusion 4*d* can be readily achieved for example by manually rotating screw 4*b* along with head 4*a*. Alternatively, only protrusion 4*d* may be rotated below cover 2 using a jig such as a bar.

Then, screw 4*b* is rotated along with head 4*a* in the direction indicated by the arrow shown in FIG. 5. At this time, screw 4*b* can be rotated while forcing the upper surface of protrusion 4*d* against the bottom surface of cover 2 so as to prevent rotation of protrusion 4*d*. Screw 4*b* may also be rotated while preventing rotation of protrusion 4*d* using the above mentioned jig such as a bar. The aforementioned specific jig is preferably used for rotating screw 4*b*. By rotating screw 4*b* using such a jig, rotation of screw 4*b* can be accomplished in a much more simple and efficient manner as compared with the case in which screw 4*b* is manually rotated.

As in the foregoing, by separately rotating screw 4*b* and protrusion 4*d* after inserting screw 4*b* into through hole 1*a* and cutout portion 2*a*, protrusion 4*d* and the bottom surface of cover 2 can be engaged and head 4*a* is moved in a direction which comes closer to tube like portion 4*c*. Therefore, cover 2 and decking 1 can be pinched and fixed between the bottom surface of head 4*a* and the upper surface of protrusion 4*d*.

It is noted that in the above described embodiment, a stacked structure of cover 2 made of concrete and decking 1 is fixed using fixture 4. The present invention is also applicable to any plate other than that mentioned above, as long as a plurality of such plates are provided in a stack. In addition, while cutout portion 2*a* is formed at the end of cover 2 in the above described embodiment, the present invention is also applicable even when a through hole passing through cover 2 in a direction of thickness is provided. Further, as for the shape of protrusion 4*d*, the shape other than that shown in FIGS. 1 to 5 may be used as long as it allows passage thereof through the first through hole 1*a* and cutout portion 2*a* and engagement with the bottom surface of cover 2 by rotation thereafter.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An arrangement comprising a channel having a U-shaped cross-section with an open side, a first plate that has a first hole therethrough and that is arranged on said open side of said channel and not secured to said channel, a second plate that has a second hole therethrough and that is stacked on said first plate, and a fixture arranged to fix said second plate onto said first plate, wherein said fixture comprises:

a head;

a screw extending from said head and having a male threading on its outer surface;

a tube-like portion that has a female threading on an inner surface thereof and that receives said screw therein; and a protrusion protruding outwardly from an outer surface of said tube-like portion; and wherein said first and second plates are pinched together and fixed between said head and said protrusion with said screw passing through said first and second holes.

2. The arrangement according to claim 1, wherein said first and second holes each have an elongated shape with a first opening width and a second opening width which is smaller than said first opening width, and a sum of a length of said protrusion and a width of said tube-like portion is smaller than said first opening width and larger than said second opening width.

3. The arrangement according to claim 1, wherein said head has a pair of holes therein for rotating said screw.

4. The arrangement according to claim 1, wherein said first plate is a cover placed on edges of said channel bounding said open side, said second plate is a decking made of resin, said protrusion includes first and second protruding members, and said first and second protruding members respectively protrude in opposite directions.

5. The arrangement according to claim 1, wherein said protrusion has an upper surface extending in a direction parallel to a back surface of said first plate.

6. The arrangement according to claim 1, wherein said protrusion has an upper surface which is to abut against a back surface of said first plate, and which has a surface configuration so as to prevent rotation of said protrusion with respect to said back surface of said first plate.

7. The arrangement according to claim 1, comprising a plurality of said first plates, a plurality of said second plates, and a plurality of said fixtures, wherein said first plates are arranged side-by-side adjacent one another on and along said open side of said channel, said second plates are arranged side-by-side adjacent one another on said first plates and are offset relative to said first plates such that each said second plate overlaps respective portions of two underlying ones of said first plates, and wherein each said fixture is arranged to fix each said second plate onto two adjacent ones of said first plates or to fix each said first plate together with two adjacent ones of said second plates.

8. The arrangement according to claim 7, wherein each said fixture is arranged to fix each said second plate onto two adjacent ones of said first plates, whereby said plurality of first plates and said plurality of second plates are all interconnected together by said plurality of fixtures to form an interconnected unit comprising all of said first plates, all of said second plates and all of said fixtures.

9. The arrangement according to claim 8, wherein each said first hole through each said first plate respectively comprises a cut-out along an edge of said first plate, and each said second hole through each said second plate respectively comprises a through hole passing through a central body portion of said second plate.

10. The arrangement according to claim 1, wherein said first plate consists of concrete and said second plate consists of resin plastic.

11. The arrangement according to claim 1, wherein said second plate is stacked on said first plate such that said second hole aligns with said first hole, and said first and second holes each respectively have dimensions such that said screw, said tube-like portion and said protrusion can pass through said second hole and said first hole when said protrusion is oriented in a first rotational orientation about an axis of said screw relative to a hole orientation of said first and second holes, and such that said protrusion cannot pass through said first hole when said protrusion is oriented in a second rotational orientation that is rotationally offset by 90° relative to said first rotational orientation about said axis.

12. A method of assembling and fixing together the arrangement of claim 1, comprising the following steps:

a) loosely placing said first plate on said open side of said channel;

b) placing said second plate onto said first plate such that said second hole is aligned over said first hole;

c) inserting said screw with said tube-like portion screwed thereon into and through said second hole and then into and through said first hole, so that said protrusion is brought to a position on a back side of said first plate facing toward said channel and away from said second plate;

d) rotating said protrusion about an axis of said screw relative to said first and second plates; and e) rotating said screw about said axis relative to said first and second plates and relative to said protrusion, so as to pinch together and fix said first and second plates between said protrusion and said head.

13. The method according to claim 12, wherein said first and second holes each respectively have a first opening width that allows passage of said protrusion therethrough and a second opening width smaller than said first opening width, and wherein said protrusion gets caught behind said back side of said first plate and cannot pass back through said first hole when said protrusion is rotated into a fixing position in said step d).

14. The method according to claim 12, wherein all of said steps are carried out from a front side of said second plate facing away from said channel and said first plate, without requiring access into said channel.

15. The method according to claim 12, wherein said step d) is performed by rotating said head of said fixture, and said step e) is performed by rotating said head of said fixture while lifting said head in a direction away from said plates so as to abut said protrusion against a plate surface of said first plate on said back side of said first plate.

* * * * *

UNITED STATES PATENT AND TRADEMARK OFFICE

CERTIFICATE OF CORRECTION

PATENT NO. : 5,997,210

DATED : Dec. 7, 1999

INVENTOR(S) : SHIRAKAWA

It is certified that error appears in the above-identified patent and that said Letters Patent is hereby corrected as shown below:

Title Page: under "Attorney, Agent, or Firm-", before "W. G. Fasse", insert --W. F. Fasse--;

Under [57] "ABSTRACT",
line 8, before ".", replace "feature" by --fixture--,
after "a", replace "positioned" by --positional--;
line 9, after "a", replace "attached" by --stacked--.

Col. 1,
line 34, before "U shaped", replace "an by" by --a--;

Col. 2, line 37, after "hole", insert --,--.

Signed and Sealed this

Fifteenth Day of August, 2000

*Attest:*

Q. TODD DICKINSON

*Attesting Officer*

*Director of Patents and Trademarks*